United States Patent [19]

Goodwin

[11] 4,186,718

[45] Feb. 5, 1980

[54] STOVES

[76] Inventor: Paul O. Goodwin, Box 52, R.D. 2, Mehoopany, Pa. 18629

[21] Appl. No.: 866,654

[22] Filed: Jan. 3, 1978

[51] Int. Cl.[2] ..... F24B 3/00; F24C 15/08

[52] U.S. Cl. ..... 126/67; 126/61; 126/66; 126/201; 126/279

[58] Field of Search ..... 126/66, 67, 146, 279, 126/61, 201, 277, 278

[56] References Cited

U.S. PATENT DOCUMENTS

| | | | |
|---|---|---|---|
| Re. 6,460 | 5/1875 | Brownell | 126/279 |
| 134,563 | 1/1873 | Rose | 126/279 |
| 141,106 | 7/1873 | Bingham et al. | 126/279 |
| 692,164 | 1/1902 | Miller | 126/67 |
| 1,659,694 | 2/1928 | Lehman | 126/67 |
| 1,734,578 | 11/1929 | Herrenbruck | 126/67 |
| 2,048,354 | 7/1936 | Sanford | 126/67 |
| 2,345,329 | 3/1944 | Crowell | 126/67 |
| 2,467,577 | 4/1949 | Baldwin | 126/67 |
| 2,487,264 | 11/1949 | Nelson | 126/67 |
| 4,050,441 | 9/1977 | Horwinski | 126/66 |

FOREIGN PATENT DOCUMENTS

| | | | |
|---|---|---|---|
| 639003 | 3/1928 | France | 126/66 |

*Primary Examiner*—Samuel Scott
*Assistant Examiner*—Daniel J. O'Connor
*Attorney, Agent, or Firm*—David A. Tamburro

[57] ABSTRACT

Fire preventing shielding and air circulation apparatus for use with a box-type stove includes means for forming a chamber bounded at its top by the bottom of the firebox of the stove using a flat panel and upwardly extending apertured sides. A preferred embodiment also includes a stack formed on and bounded by the rear side of the stove and connected to communicate with the chamber.

11 Claims, 10 Drawing Figures

STOVES

My invention relates to woodburning stoves and attachments therefor, and more particularly, to heat-shielding and air circulation and apparatus for woodburning stoves which have solid or closed metal bottoms, lined with fire brick or the like, and which draw combustion air from above the bottom. Stoves of this type are generally called box-type stoves, are generally made of sheet steel in a rectangular configuration, and are to be distinguished from grate-type stoves having an undergrate draft system. Box-type stoves are rapidly increasing in popularity in some sections of the country due to the increasing cost of fossil fuels, dangers that fossil fuels supplies may be interrupted, and the increased availability of firewood in some areas. Also, some such stoves are installed for use as emergency heating in the event of an electric power outage.

Use of box-type woodburning stoves has suffered to some extent because some improperly installed stoves have caused serious fires. Gas-fired and oil-fired furnaces and heaters have often been preferred over woodburning stoves not only because they usually require less attendance by an operator, but also because the feeding of fuel to such furnaces can be automatically controlled with simple and inexpensive controls to limit furnace temperature, and furnace temperature depends very little upon stack draft. The temperatures within a woodburning stove tend to vary greatly, however, depending upon the amount of unburned wood in the stove, the type and moisture content of the wood, and the draft at the stove flue or chimney. The recent increased use of woodburning stoves has resulted in many persons who have had little or no experience with woodburning stoves often operating them in a dangerous manner. These factors have sometimes resulted in box-type woodburning stoves becoming seriously overheated, so that adjacent portions of a building have burned. One general object of the invention is to provide an improved woodburning box-type stove assembly which is safer.

It is usually a rather simple matter to prevent heat radiated from the walls of a box-type stove from burning any wall of the room in which the stove is situated, by merely mounting the stove a sufficient distance from the room walls, but preventing a stove from burning the floor upon which it is carried presents a more difficult problem. A stove must be mounted fairly low near the floor or the lower portions of the room remote from the stove fail to be adequately heated. In practice the art has settled on a compromise wherein the bottom of the firebox is supported typically eight or ten inches above the floor on a plurality of legs, and special fireproof floor materials such as ceramic or stone tiles have been used to form the floor area beneath the stove. For example some manufacturers of box-type stoves currently recommend that such stoves be carried on tiles or masonry at least four inches thick. Furthermore, even when carried on such a thick base of tile or masonry, most box-type stoves of which I am aware still tend to present some fire hazard. For example, toys or clothing accidentally placed under such a stove can catch fire and cause serious danger. The expense of tiling a floor area in order to safely accommodate such a woodburning stove has discouraged some persons from installing such stoves.

One important object of the present invention is to provide a simple and effective means for drastically decreasing the heat which a box-type wood-burning stove radiates downwardly toward underlying and surrounding floor areas, thereby to markedly decrease fire dangers which have been associated with woodburning stoves. Use of the present invention so markedly reduces the temperatures to which such floor areas are subjected that provision of a satisfactory floor becomes much less expensive. With use of the present invention the heat transmitted toward the floor is so reduced that a box-type stove can be safely mounted even on a bare wooden floor or a carpeted floor, although it is contemplated that a metal plate, thin layer of stone, or fireproof mat usually still will be used beneath the stove, mainly for the purpose of preventing damage from flying sparks when the stove door is open. The improved stoves of the present invention can be situated above fiberglass or other fireproof rugs or mats generally similar to welding mats designed to resist sparks.

Some related prior art is shown in the following prior U.S. Pat. Nos.:

105,773 (Reissue No. 6,460), 134,563, 137,291, 148,028, 148,030, 163,450, 178,917, 252,312, 374,235, 750,355, 1,551,067.

It is highly desirable in order to conserve fuel (wood), that a maximum amount of heat from that produced by combustion be transmitted to the room rather than escaping up the stack, and another object of the invention is to provide a box-type woodburning stove having better heating efficiency. Various systems using motor-driven fans can increase heating efficiency by circulating room air, but they have the marked disadvantage of requiring electric power, and the further disadvantage that they tend to produce noise. One object of the present invention is to provide an improved box-type woodburning stove having improved efficiency which does not require a fan nor the use of electric power.

Various stove platforms which decrease heating of the floor beneath a stove have been known for many decades. Many known stove platforms include a conical or spherical reflector situated on a floor some distance beneath a stove to reflect downwardly-radiated heat upwardly and laterally outwardly from beneath the stove. Some of the prior art recognizes that some additional circulation of heat can be obtained, and ventilation of moisture from beneath such a platform can be obtained, if such a reflector is provided with a plurality of openings to allow air to circulate beneath such a reflector. The present invention differs markedly from such prior art in that no separate, lower floor-carried platform is used, and instead, metal panel means are used to form a chamber directly below the firebox of the stove, with the hot bottom of the firebox forming the top of the chamber. Further, while the metal panel is used beneath the firebox of the stove to intercept downward heat radiation, no attempt is made to reflect heat laterally outwardly, and instead, side apertures are provided around the chamber formed beneath the firebox. One basic embodiment of the invention resembles in some respects an arrangement shown in U.S. Pat. No. 1,551,067 for an undergrate stove, but differs importantly in that upwardly extending sides are provided on the lower metal panel, apertures are provided on such sides above the level of the lower metal panel, and the bottom of the firebox, rather than an ashpan, forms the top of the chamber. While U.S. Pat. No. 1,551,067 teaches use of a flat horizontal lower panel so as not to interfere with air circulation, and while such an arrangement may be preferable with an undergrate stove where much less heat tends to be directed downwardly, it has been found that use of side panels with apertures, or in essence the use of restrictions to air flow, causes much more effective room heating in the case of a box stove where an air-circulation chamber is formed just below the fire box. With the apertures located above the lower panel, extremely effective air circulation results. Further, by providing discrete apertures in the side panels rather than completely open spaces above the lower panel, it appears that air velocity is increased as air enters the chamber below the firebox, providing much greater turbulence inside the chamber and therefore much better heat transfer.

In a preferred embodiment of the invention the basic concepts mentioned above are used, together with a second metal panel means which forms a vertical passageway on one side of the stove, usually the rear side. The vertical passageway is bounded on its inner side by the hot rear side of the stove and tends to act in the nature of a stack, expelling warmed air from its upper end, and importantly, the vertical passageway communicates with the chamber formed just below the firebox, pulling air into and through the lower horizontal chamber near the bottom of the stove.

A large number of box-type stoves are presently installed, and an important further object of the invention is to provide attachments, in kit form, for example, with which existing stoves may be readily modified to provide the safety and heating efficiency advantages mentioned above in a simple and inexpensive manner, without a need for disturbing such existing installations or making radical changes in basic stove structure, and without the use of special tools.

Other objects of the invention will in part be obvious and will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which.

Figure 2:
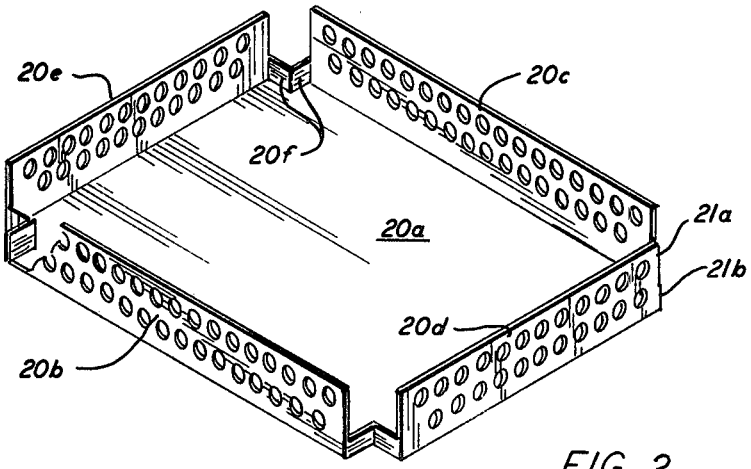
FIG. 2 is a perspective view of one elementary form of heat shield and air circulation panel means according to the invention.
Figure 3:
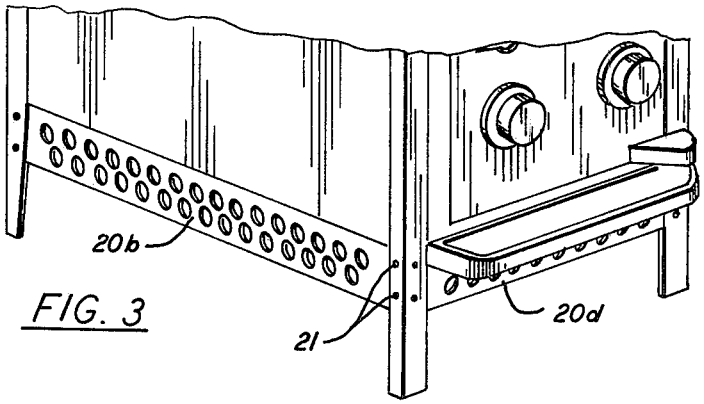
FIG. 3 is a partial perspective view of the stove of FIG. 1 showing the panel means of FIG. 2 installed in place.
Figure 3A:
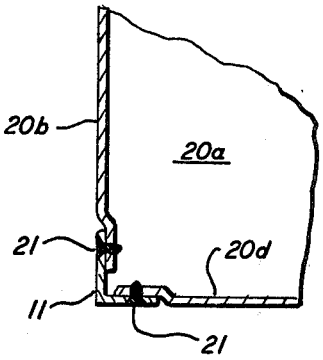

FIG. 3*a* is a downward cross-sectional view illustrating one manner in which side panel portions of the panel means of FIG. 2 may be affixed to the legs of the stove.

Figure 4:
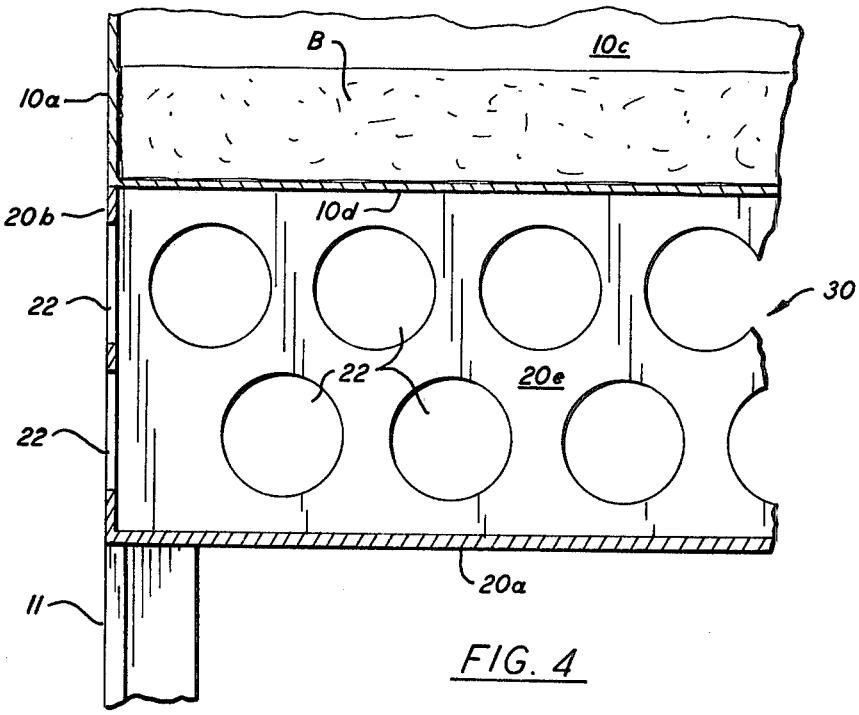

FIG. 4 is a partial cross-section elevational view looking rearwardly at the assembly shown in FIG. 3.

Figure 5:
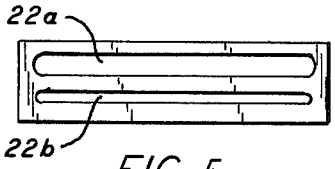

FIG. 5 is a side elevation view illustrating one possible modification which may be made in side panel portions of the panel means shown in FIG. 2.

Figure 1:
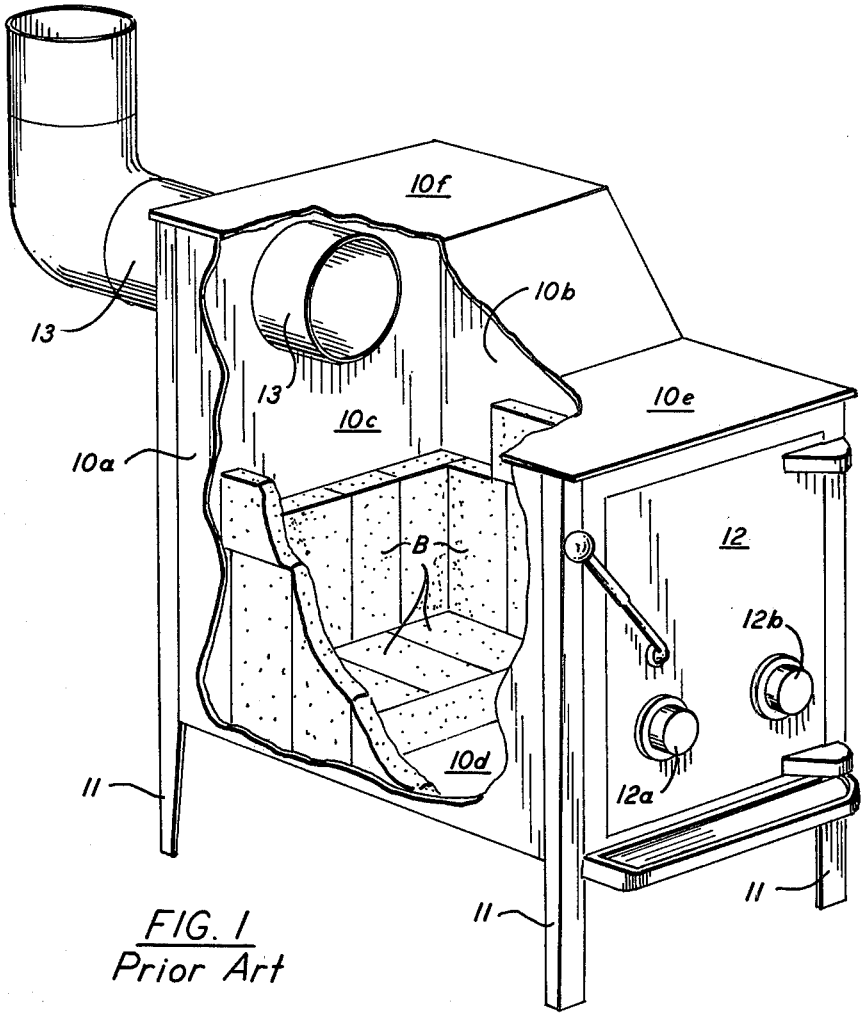
FIG. 1 Prior Art
FIG. 1 is a perspective view, with certain portions cut away, of a typical prior art box-type stove with which the present invention is intended to be used.
Figure 6:
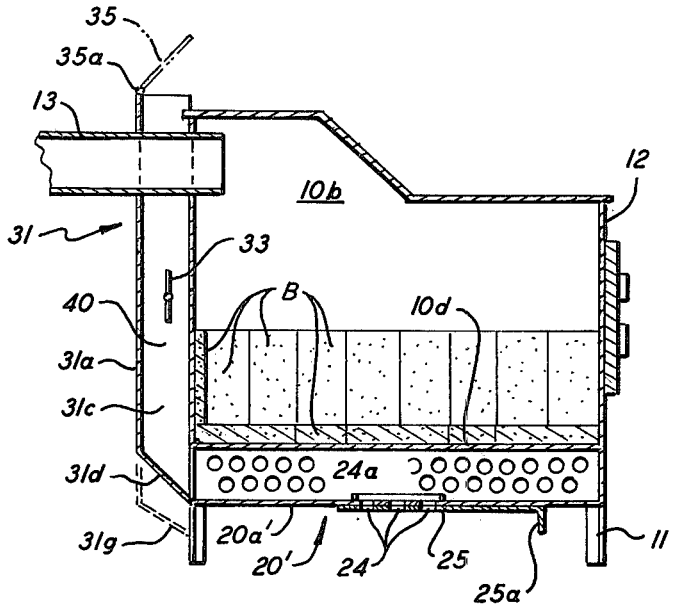

FIG. 6 is a side elevation cross-section view showing a stove of the type shown in FIG. 1 fitted with a preferred form of the invention.

Figure 6B:
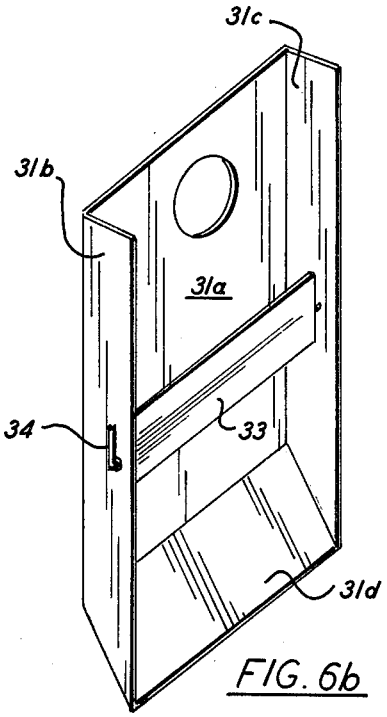
Figure 6A:
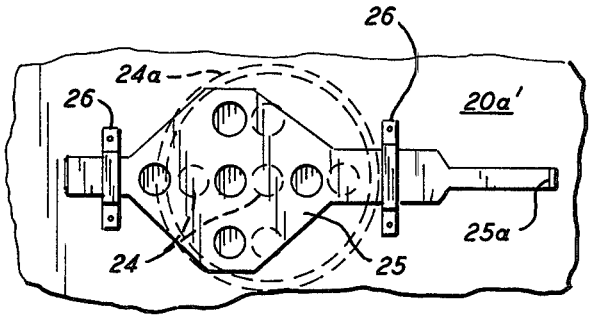

FIG. 6*a* is an upward view toward a portion of the bottom of the assembly shown in FIG. 6.

FIG. 6*b* is a perspective view of a portion of the assembly of FIG. 6.

Figure 7:
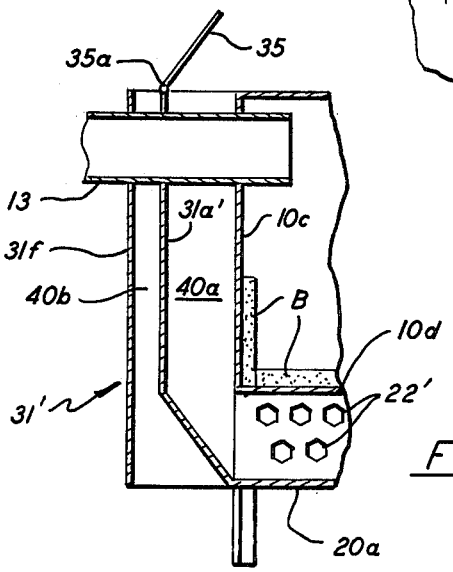

FIG. 7 is a partial view similar to FIG. 6 illustrating one possible modification of the embodiment of FIG. 6.

As a preliminary to an understanding of the present invention, reference should be had to FIG. 1 wherein one known form of box-type stove is shown, with certain parts cutaway. The stove in FIG. 1 generally comprises a rigid welded box-like sheet-metal structure having its two sides 10*a*,10*b*, a rear or back side 10*c*, and a bottom plate 10*d* mounted on four corner legs 11, only three of which are visible in FIG. 1. The front side of the box carries a hinged door 12. The bottom plate 10*d* and portions of the sides 10*a*–10*c* are shown lined with fire brick B,B. A flue pipe 13 extends horizontally from the back panel 10*c* of the stove and typically connects to a chimney flue (not shown). The stove is shown with the sides having varying heights from front to rear thereby providing two separate top or cooking surfaces 10*e* and 10*f*, which tend to become heated to two different temperatures due to their different distances from a fire (not shown) which one may kindle atop the fire brick covering the bottom plate 10*d*. The present invention is applicable irrespective of whether the stove has top surfaces at several different levels. The door 12 is usually closely fitted to its opening at the front of the stove so that the stove tends to be air-tight, except for the flue pipe 13, and except for controlled amounts of air which may be drawn into the inside of the stove through adjustable air-flow control valves 12*a*,12*b* shown carried in door 12. The stove of FIG. 1 has been drawn to generally resemble a commercially available box-type stove of a type sold by Fisher Stoves of Pennsylvania, Inc., of Factoryville, Pa., but it will become apparent to those skilled in the art as the description proceeds that basic principles of the invention are readily applicable to a wide variety of differing yet generally similar box-type stoves. In a typical stove of the type shown, the bottom and four sides of the stove are formed of one quarter inch hot-rolled steel sheet, with 1"×4"×8" fire bricks being used to line the box as shown, and with hot-rolled steel sheet say ¼" or 5/16" thick being used to form upper surfaces 10*e* and 10*f*. The use of steel sheet construction, as opposed to the cast iron construction widely used in older stoves, offers important economies vital to production of such stoves, as well as providing stoves which can provide significant room heating more rapidly than cast iron stoves; however, the lesser thermal mass of such sheet metal stoves disadvantageously can tend to allow overheating in a much more rapid manner. When a stove of the type shown in FIG. 1 is properly used, with limited air admitted through control ports 12*a*,12*b*, a single charge of logs can provide generally smooth and even heating without operator attendance over a substantial time period, of the order of 8 to 12 hours, which is an important factor in the popularity of such stoves.

The room heating which such a stove provides depends upon the temperature difference between the ambient room air and the outer surfaces of the stove, and the surface area of those external surfaces of the stove. Heat escaping up flue pipe 13 tends to be wasted, hence pipe 13 is usually routed to produce maximum heating of stove surfaces and minimum heating of the flue pipe. To avoid a requirement that such a stove have a very large outer surface area and hence be unduly large, it is necessary that combustion occur at a rate so as to maintain outer surfaces of the stove at a substantially high temperature. When a typical fire is kindled atop the fire brick bottom of the stove chamber, a "hot spot" usually develops on the undersurface of the bottom plate 10*d* with the temperature of the hot spot substantially exceeding that of other portions of the bottom plate. Substantial heat is radiated downwardly from the bottom plate, and unless the bottom plate is supported sufficiently above the underlying floor surface by legs 11, or unless a thick special floor surface such as tile or brick is used, the downwardly radiated heat can readily ignite various floor surfaces. Dangers associated with downward heat radiation can be lessened to some extent by lengthening legs 11 to support bottom plate 10*d* at a greater height above the floor surface, but such a strategm offers no practical solution because it decreases the surfaces areas of the sides of the stoves and hence the stove heating capacity, unless the top surfaces of the stove are raised an equal amount, which may place them too high for convenient use for cooking. Furthermore, generally raising the stove tends to leave a lower layer of room air barely heated, often giving room occupants cold feet and providing a chilly environment for small children and pets occupying room levels adjacent the floor. A fire of sufficient intensity within the stove often can overheat the sides, rear and front of the stove as well as the bottom plate. Such overheating of the sides and front ordinarily causes less danger, since one ordinarily can locate the sides and front of the stove substantially distant from any room wall. It is important to recognize that bottom plate 10*d* and the floor surface directly below that bottom plate tend to be hidden from view from occupants of the room wherein such a stove is installed, so that overheating can easily be overlooked. To minimize clutter most persons prefer to install such a stove with its rear side fairly close to a wall and hence not readily visible, and thus overheating of the rear side of such a stove also tends to create some danger.

In FIG. 2 one elementary embodiment of shield panel according to the invention is shown in an isometric view. In FIG. 3 the shield panel of FIG. 2 is shown fitted to the bottom of a stove to the type illustrated in FIG. 1, and FIG. 4 is a partial front-to-back elevational cross-section view of such an assembly. As seen in FIGS. 2–4 panel means 20 comprises a closed lower panel portion 20*a* and four side panel portions 20*b*, 20*c*, 20*d* and 20*e*, with each of the side panel portions shown having a plurality of apertures 22. Panel 20*a* preferably extends coextensively with the firebox bottom plate 10*d* of the stove, except for portions cut out at the corners for the stove legs. In FIG. 2 lower panel 20*a* is shown formed integrally with the side portions, and while such construction is preferred, it will be recognized that any or all of the side portions can comprise separate pieces attached to panel 20*a* in any convenient manner. As best illustrated in FIG. 3*a*, the ends of each side panel portion are provided with slightly offset tab portions which extend inside the angle iron legs of the stove, so that screws 21 passing through the legs and threaded through holes in the panel means hold panel means 20 in place adjacent the firebox bottom panel of the stove, forming a chamber 30 (FIG. 4).

It is of substantial importance that the panel means 20 can be readily fitted to a wide variety of existing stoves by merely drilling holes in the existing stove legs, temporarily disconnecting the flue pipe and slightly lifting the stove to allow the panel means to be slipped beneath the stove. If the panel means is formed of separate parts, the stove need not even be moved at all in order to install the panel means.

The upper edges of vertical side portions 20*b*–20*e* extend adjacent to respective edges of firebox bottom plate 10*d*, which forms the top of chamber 30. Each aperture 22 in each side plate portion will be seen to extend above the upper surface of lower panel portion 20*a*, and thus air can flow in and out of the chamber through the apertures by moving horizontally. Referring to FIG. 4, as firebox bottom plate 10*d* radiates intense heat downwardly, any quantum of air within the chamber tends to rise as it is heated and expands. Further, cooler air tends to be drawn into the chamber through the lower row of apertures in each side plate portion than that expelled through the upper row of apertures in each side plate portion. With the arrangement shown, a complex air flow pattern occurs, providing substantial turbulence within the chamber, resulting in a surprising amount of heat transfer. The circulation induced and heat transfer accomplished is such that lower panel portion 20*a* and side panel portions 20*b*–20*e* remain comfortably warm and the floor surface remains far below any dangerous temperature.

In one embodiment constructed of 20 gauge steel sheet substantially in accordance with FIGS. 2–3, panel 20*a* had a length of 23 inches (between front and rear side portions 20*d* and 20*e*) and a width of 28 inches between side panel portions 20*b* and 20*c*, or an area ( neglecting the cutout portions for the stove legs) of approximately 644 square inches. Each side panel portion provided a vertical chamber dimension of 2.0 inches; thus front and rear panels 20*d* and 20*e* each provided a total chamber area of about 46 square inches, side panel portions 20*b* and 20*c* each provided a total chamber area of about 56 inches, and the total area of all four side panel portions was about 204 square inches, or about 32% of the area of the firebox bottom plate 10*d* and lower panel portion 20*a*. In the specific embodiment described, the stove legs located the firebox bottom plate 10*d* about 4 inches above the floor. With such an arrangement chamber 30 will be seen to have extended vertically from the firebox bottom plate approximately 33% of the distance to the floor. While front and rear portions 20*d* and 20*e* each had a total area of about 46 square inches, the apertures in each of those panel portions presented total open areas of only about 28 square inches, so that panel portions 20*d* and 20*e* were about 61% open and 39% closed. While side panel portions 20*b* and 20*c* each had a total area of about 56 square inches, the apertures in each of those panel portions presented total open areas of only about 24 square inches, so that panel portions 20*b* and 20*c* were about 43% open and 57% closed. The side panel portions will be seen in one sense to restrict or decrease horizontal air flow from what would occur were they absent. However, because they tend to contain air within the chamber long enough to adequately heat it, and/or because they create turbulence of the air in the chamber, very efficient room heating occurs while very little heat is transmitted to the floor beneath the stove.

While it is by no means necessary, it is believed that slightly improved operation occurs if the total open area of the lower row of apertures in each side panel portion is slightly less than that of the upper row, by 3 to 15%, for example. This can be readily accomplished, of course, by providing holes of slightly different diameters in the two rows, or by providing holes of the same diameter but with different numbers of holes in the two rows. The holes in the upper row are preferably horizontally staggered midway between those of the lower row. It is by no means necessary that the apertures in each side panel portion comprise circular holes, as they may be rectangular or have other shapes. Further, as is illustrated in FIG. 5, a side panel portion can utilize upper and lower elongated slots 22*a*,22*b* instead of upper and lower rows of plural holes, although the use of plural rows of holes is believed to advantageously create greater turbulence leading to better heat transfer.

In FIG. 2 pairs of tab portions 20*f*,20*f* are shown extending upwardly at each corner of panel means 20, up to approximately the lower edges of the lower apertures in the side panel portions, and are welded to each other and to adjacent side panel portions, thereby forming a water-tight trough up to the level of those apertures. One can insert water into any of the apertures 22 so as to cover bottom panel 20*a*, and air flow in and out of the chamber then will effectively humidify the rooms heated by the stove. The evaporation of water also tends to maintain panel 20*a* and hence the floor surface cooler, of course. Providing panel means 20 with a water-tight bottom and the use of water is by no means necessary, however, to effectively protect the floor surface.

In the cross-section elevation view of FIG. 6 the preferred embodiment of the invention includes panel means 20' generally similar to that previously described which functions to establish a chamber directly below and bounded at its top by firebox bottom plate 10*d*, atop which firebrick B,B is carried, but unlike previously described panel means 20, the panel means 20' of FIG. 6 includes no rear side portion akin to portion 20*e* of FIGS. 2–4, and lower panel portion 20*a'* in FIG. 6 preferably includes a plurality of openings 24 generally centered below firebox bottom plate 10*d* at the "hot spot", i.e. the area of plate 20*d* directly below where maximum temperature tends to occur. An adjustable gate or valve means 25 is preferably situated adjacent openings 24 to allow their open area to be adjusted, as is shown in greater detail in FIG. 6*a* described below. In some embodiments of the invention openings 24 may be omitted, in which case, of course, gate 25 also will be omitted.

A further U-shaped sheet-metal panel means 31 shown isometrically in FIG. 6*b* is fitted on the rear side 10*c* of the firebox of the stove, preferably extending entirely across the width of the rear side and from bottom to top of the rear side. In FIG. 6 panel means 31 is shown extending slightly above the top of the stove, though that is not a requirement. Panel means 31 will be seen to include a vertical rear portion 31*a*, closed left and right side portions 31*b* and 31*c* and a closed bottom portion 31*d* which preferaby slopes downwardly from rear to front as shown. Rear panel portion 31*a* is shown provided with an opening 31*e* through which flue pipe 13 may extend when the invention is used with a stove having a rearwardly exiting flue pipe, and no such opening need be provided, of course, if the flue pipe extends vertically from the top of the stove or from a different side of the stove. An optional damper plate 33 is shown pivotally mounted between sides 31*b*, 31*c* of panel means 31, with a handle 34 extending outside to facilitate pivotal adjustment of the damper plate. The edges of vertical side plate portions 31*b*, 31*c* extend to the rear side 10*c* of the stove firebox, and bottom portion 31*d* slopes down to abut the rear edge of horizontally-extending lower panel 20*a'*. Metal panel means 31 thus will be seen to provide a closed vertical passageway 40 on the rear side of the stove which communicates with the rear end of the lower chamber formed by lower panel means 20', and the closed vertical passagway will be seen to be bounded on its front side by the rear face 10*c* of the firebox of the stove. As heat radiates from rear side 10*c* it warms the air in the vertically-extending passageway, causing that air to rise and inducing a very substantial upward draft in vertical passageway 40, expelling warm air out the open upper end of passageway 40. The draft so induced in vertical passageway 40 pulls substantial air into lower horizontally-extending chamber 30 throgh the apertures in side plate portions 20*b*,20*c* and front plate portion 20*d* of lower panel means 20*a'*, and also pulling air upwardly into chamber 30 through openings 24 in an amount controlled by the adjustment of gate 25. As cool air flows upwardly through openings 24 just below the "hot spot" on firebox bottom plate 10*d*, extensive turbulence tends to result within chamber 30. While one might expect intense heat to be radiated downwardly through openings 24, it has been found that so much air flow is induced that the floor below the openings, and even the panel 20*a'* area adjacent the openings remains remarkably cool even when a very intense fire is burning in the stove. The amount of draft induced in vertical passageway 40 may be controlled by pivotal adjustment of damper plate 33. As damper plate 33 is pivoted to reduce upward air flow through passageway 40, a larger percentage of heat is emitted from the upper apertures of side plates 20*b* and 20*c*. If damper plate 33 is pivoted to fully close passageway 40, the embodiment of FIG. 6 tends to operate substantially like the embodiment shown in FIG. 3. If desired, damper plate 33 may be located above or below the position where it is shown in FIGS. 6 and 6*b*. In FIG. 6 an optional deflector-damper plate 35 is shown hingedly attached to panel means 31 at the top of passageway 40 by means of hinge 35*a* which holds plate 35 in the position to which it is adjusted. In the absence of plate 35, the hot air rising from the top of the stove itself tends to push the air emerging from passageway 40 somewhat rearwardly, and in many applications, such as where it is desired to locate passageway 40 rather near a wall, it is desirable to direct heat forwardly, and it will be apparent that plate 35 may be adjusted to perform that function. Further, it will be noted that as plate 35 is adjusted progressively downwardly it increasingly restricts air flow through passageway 40 and hence functions as an adjustable damper.

It may be noted that because vertical passageway 40 provides a draft tending to draw in room air, it is by no means necessary that panel means 31 be fitted precisely air-tight around flue pipe 13 or fitted air-tight to the rear face 10*c* or to lower chamber 30, though it is desirable, of course, that vertical passageway 40 not leak so extensively as to draw substantial air from places other than lower chamber 30. While vertical panel means 31 is shown as comprising an integral sheet metal structure and such an arrangement may be preferred in most applications, it may be pointed out that due to the very substantial draft passing through its passageway, most portions of panel means 31 tend to remain very cool, i.e. near or reasonably above room temperature, so that some portions of panel means 31 may be fabricated from materials other than sheet metal in some embodiments of the invention, such as plastic or asbestos sheeting, for example, which advantageously facilitates decoration. While FIG. 6 illustrates provision of panel means 31 and vertical passageway 40 on the rear side of the stove, it will become apparent upon reflection that they could instead or in addition, be provided on either lateral side of the stove and still connected to communicate with lower chamber 30 in similar fashion.

In one practical embodiment of the invention, the cross-sectional area of vertical passageway 40 was approximately 84 square inches and the height or length of the passageway was approximately 26 inches. The cross-sectional area of passageway 40 preferably equals or exceeds that of chamber 30 (looking rearwardly). In some embodiments of the invention the bottom of passageway 40 may be arranged to extend down below chamber 30 as shown by dashed lines at 31*g* in FIG. 6, so that passageway 40 draws air from below chamber 30 as well as from chamber 30.

In the upward view of FIG. 6*a* gate means 25 is shown as comprising a plate slidably held against the bottom of lower panel 20*a'* by means of straps 26,26 riveted to panel 20*a'*. Plate 25 includes a plurality of apertures arranged in the same pattern as openings 24 in panel 20*a'*, the latter openings being shown by dotted lines in FIG. 6*a*. Plate 25 also has a depending handle portion 25*a* which is reachable underneath the stove, and by means of which one can slide gate plate 25 to vary the amount by which its openings register with the openings 24 and thereby adjust the amount of air drawn from underneath chamber 30 and directed upwardly to the hot spot. A rotating rather than sliding gate may be substituted without departing from the invention. In FIG. 6*a* an annular lip or ring 24*a* is shown surrounding holes on the upper side of panel 20*a'* to prevent water from flowing out holes 24, and the ring is, of course, unnecessary in embodiments not intended to carry water on lower panel 20*a'*.

In FIG. 7 a modified panel means 31' includes not only a first vertical passageway 40*a* bounded by the rear face 10*c* of the stove and communicating with the understove chamber in the manner of passageway 40 in FIG. 6, but also a second vertical passageway 40*b* which is open at its bottom as well as at its top. Passageway 40*b* acts as a second stack, with cool air from near the floor rising through the passageway. Because rear face 10*c* is much, much hotter than panel 31*a'*, much more draft occurs in passageway 40*a* than in passageway 40*b*, but by use of passageway 40*b* rearmost panel 31*f* can remain very near room temperature even when a very intense fire is burning within the stove, so that rear panel 31*f* can be located very near a room wall without danger.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privelege is claimed are defined as follows:

1. For use with a stove generally of box shape having a bottom lined with a layer of fire resistant material, a plurality of vertical sides, a top, and a plurality of legs supporting the stove with its bottom spaced above a floor surface, heat shielding and air circulating attachment means comprising first panel means adapted for ready attachment beneath the bottom of said stove and having a substantially horizontal plate portion and a plurality of substantially vertical side portions extending upwardly from said plate portion, said plate portion and side portions having means adapted to accommodate the legs of the stove whereby said first panel means is readily attachable beneath the bottom of the stove with the upper edges of said vertical side portions adjacent the bottom so as to form a substantially horizontal air passageway between the bottom and said horizontal plate portion, said vertical side portions including a plurality of apertures through which air enters said passageway to cool the bottom of the stove and shield the floor surface underneath.

2. The heat shielding and air circulating attachment means of claim 1 comprising second panel means adapted for ready attachment to one of the vertical sides of the stove to form a vertical passageway therewith, said first and second panel means being constructed so that said horizontal and vertical passageways communicate with each other whereby air entering said horizontal passageway through said apertures passes upwardly through said vertical passageway into the space surrounding the stove.

3. The attachment means according to claim 2 wherein said vertical passageway has a cross-sectional area substantially equal to the cross-sectional area of said horizontal passageway.

4. The attachment means according to claim 2 wherein said vertical passageway terminates at its upper end with an opening at substantially the vertical level of said top of said stove.

5. The attachment means according to claim 2 having adjustable damper means within said vertical passageway.

6. The attachment means according to claim 2 having a plate pivotally mounted at the upper end of said vertical passageway and adjustable both to deflect air emerging from said vertical passageway and to control the amount of air emerging from said vertical passageway.

7. The attachment means according to claim 1 wherein said first panel means includes an aperture in said horizontal plate portion.

8. The attachment means according to claim 7 comprising adjustable gate means connected to said first panel means for adjusting air flow through said aperture.

9. The attachment means according to claim 7 having a vertically-extending lip surrounding said aperture in the bottom of said horizontally-extending passageway to prevent water atop portions of said first panel means from flowing through said aperture.

10. The attachment means defined in claim 1 wherein said first panel means is adapted to be fastened to the legs of the stove.

11. The attachment means defined in claim 1 wherein said first panel means forms a water-tight trough.

* * * * *